US005708954A

United States Patent [19]

Ando et al.

[11] Patent Number: 5,708,954

[45] Date of Patent: Jan. 13, 1998

[54] RESUPPLYING APPARATUS AND IMAGE FORMING APPARATUS

[75] Inventors: Masao Ando, Yokohama; Masanobu Kanoto, Tokyo; Kiyoharu Yoshioka, Yokohama; Kazuhide Kudo, Higashimurayama; Makoto Nishigaki, Kawasaki, all of Japan

[73] Assignee: Canon Kabushiki Kaisha, Tokyo, Japan

[21] Appl. No.: 604,767

[22] Filed: Feb. 22, 1996

[30] Foreign Application Priority Data

Feb. 24, 1995 [JP] Japan ..... 7-036709

[51] Int. Cl.[6] ..... G03G 21/00

[52] U.S. Cl. ..... 399/402; 399/401

[58] Field of Search ..... 355/318, 319, 355/321, 311; 271/291

[56] References Cited

U.S. PATENT DOCUMENTS 5,162,859 11/1992 Hirono et al. ..... 355/313
5,225,881 7/1993 Goto et al. ..... 355/319
5,296,908 3/1994 Hatano et al. ..... 355/319
5,313,258 5/1994 Nishi ..... 355/314
5,381,220 1/1995 Acquaviva et al. ..... 355/308
5,448,348 9/1995 Azeta ..... 355/319

*Primary Examiner*—R. L. Moses
*Attorney, Agent, or Firm*—Fitzpatrick, Cella, Harper & Scinto

[57] ABSTRACT

This invention relates to a resupplying apparatus detachably attached to an image forming apparatus body which comprise a resupplying passage connecting a sheet material passage on a downstream side of an image forming means in the image forming apparatus body with another sheet material passage on an upstream side of the image forming means. Also, the resupplying apparatus comprises switchback conveying means placed in the resupplying passage for reversing the conveyance direction of the sheet material upon reception of the sheet material from a conveyer in the image forming apparatus body, said switchback conveying means at least partially assembled in the image forming apparatus body; and resupplying means for returning the sheet material to the upstream side of the image forming means through the resupplying passage.

30 Claims, 15 Drawing Sheets

RESUPPLYING APPARATUS AND IMAGE FORMING APPARATUS

BACKGROUND OF THE INVENTION

1. Field of the Invention

This invention relates to a resupplying apparatus and an image forming apparatus and, more particularly, to a resupplying apparatus detachably attached to an image forming apparatus such as an electrophotographic apparatus, an electrostatic recording apparatus, and a laser printer and to an image forming apparatus equipped with such a resupplying apparatus.

2. Description of Related Art

A conventional resupplying apparatus assembled to an image forming apparatus such as a laser printer has a mechanism in which a sheet material is resupplied to an image forming section of the image forming apparatus by switchback conveyance, or by reversing the conveying direction, of the sheet material to produce recording on one side of the sheet material after recording is made on the other side. Many of those are already made as products and actually used.

SUMMARY OF THE INVENTION

This invention is an improvement based on the conventional resupplying apparatus. It is an object of the invention to provide a resupplying apparatus that can be made smaller and more compact with reduced costs and be operated with lower noise, as well as readily handled by users.

A representative constitution of the invention, to accomplish the foregoing object, is characterized in a resupplying apparatus detachably attached to an image forming apparatus body, including: a resupplying passage connecting a sheet material passage on a downstream side of an image forming means in the image forming apparatus body with another sheet material passage on an upstream side of the image forming means; switchback conveying means placed in a part of the resupplying passage for reversing the conveyance direction of the sheet material upon reception of the sheet material from a conveyer in the image forming apparatus body; resupplying means for returning the sheet material to the upstream side of the image forming means through the part of the resupplying passage; a tray member capable of being open and closed for holding thereon the sheet materials conveyed out of an outlet of the sheet material on the image forming apparatus body; a passage switching member for switching, in association with opening and closing operation of the tray member, the conveyance direction of the sheet material (i.e. face-up passage/face-down passage); a cover member with a guide portion pivotably movable, in association with the opening and closing operation of the tray member, located around an inlet for the sheet material of the resupplying passage constituting a part of the resupplying passage; detecting means for sensing the pivoted position of the cover member to detect the open or closed state of the tray member; and automatic selecting means for selecting the conveyance direction from either one of passages or the resupplying passage by automatically switching the passage switching member while the tray member is closed.

According to the constitution thus formed, resupply of the sheet material one side of which recording is made is performed by guiding the sheet material from an outlet for the sheet material of the image forming apparatus body to the inlet for the sheet material of the resupplying apparatus by means of the passage switching means that have switched so that the sheet material's conveyance direction is directed to the resupplying passage by the operation of the automatic switching means while the tray member is closed and by means of the guide portion of the cover member disposed around the inlet of the sheet material of the resupplying apparatus, so that because the entire sheet material is placed within the image forming apparatus body and the resupplying apparatus when the sheet material is subject to the resupplying operation (in particular, during a waiting period during the switchback conveyance), the apparatus does not lose its fine shape and because no opening is made on the apparatus, the apparatus can operate with less noise and noise reflected.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF PREFERRED EMBODIMENTS

First Embodiment

Figure 1:
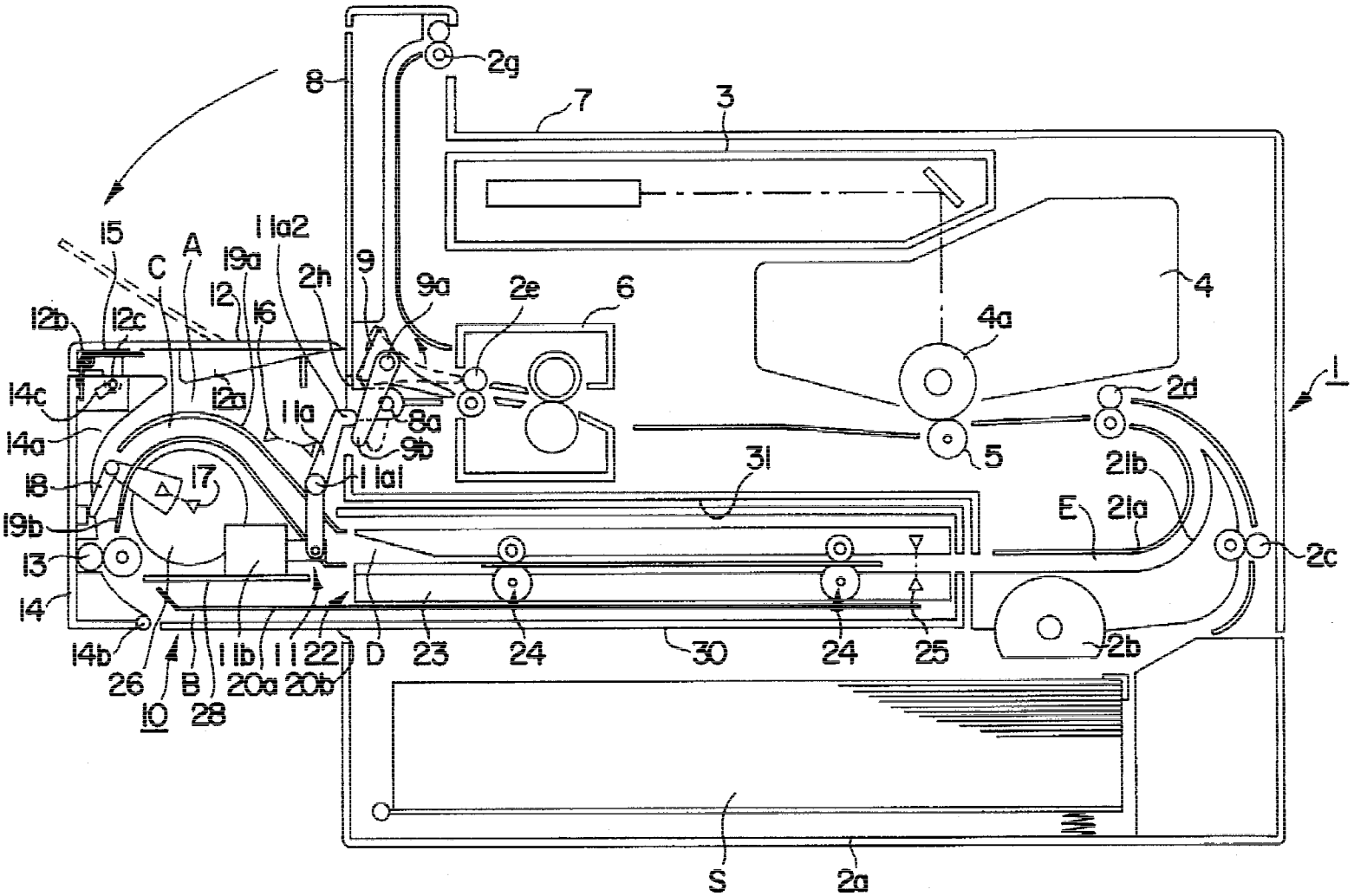
FIG. 1 is a schematic side cross section showing an image forming apparatus with a resupplying apparatus to which this invention applies.

Referring to FIG. 1, a reapplying apparatus according to the first embodiment of the invention is described. In this embodiment, a laser printer is exemplified as an image forming apparatus.

As shown in FIG. 1, an image forming apparatus body 1 is equipped with a conveying means 2 made of plural rollers or the like for conveying a sheet material S, a scanner unit 3 emitting information light based on image information onto an electrophotographic photosensitive body 4*a* in an image forming section 4, the image forming section 4 forming an image on the electrophotographic photosensitive body 4*a*, a transfer means 5 transferring the image formed on the electrophotographic photosensitive body 4*a* onto the sheet material S, a fixing means 6 fixing the transferred image to the sheet material S, and the like. It is to be noted that the image forming section 4 is formed with the electrophotographic photosensitive body 4*a* and at least one of processing means and integrated into a unit as a process cartridge detachably attached to the image forming apparatus body 1. The processing means can be, for example, a charger for charging the electrophotographic photosensitive body, a developer for developing latent images formed on the electrophotographic photosensitive body, a cleaner for cleaning residual toner on the surface of the electrophotographic photosensitive body, or the like.

The image forming apparatus is constituted to be capable of discharging the sheet material S on which recording is made so that the recorded side is up (face-up) or down (face-down); the image forming apparatus includes a face-down delivery tray 7, serving as a first tray member, for holding thereon the sheet material S delivered in facing down, a face-up delivery tray 8, serving as a second tray member, capable of being open and closed for holding thereon the sheet material S delivered in facing up, and a flapper 9 pivotally movable to switch, in association with the opening and closing operation of the face-up delivery tray 8, the conveyance direction of the sheet material S between a face-up passage and a face-down passage. The flapper 9 is constituted to be located at a position shown by a solid line in FIG. 1 when the face-up delivery tray 8 is closed for face-down operation and at a position shown by a broken line in FIG. 1 when the face-up delivery tray 8 is open for face-up operation. A cam member 9*b* is fixed to an end of a shaft 9*a* of the flapper 9. In the case when the recording section records an image on a lower side of the sheet material S, the face-down delivery tray 7 and the face-up delivery tray 8 change their positions with each other.

A resupplying apparatus 10 to resupply the sheet material S to the image forming section 4 is detachably attached to the image forming apparatus body 1 to make recording on one side of the sheet material the other side of which recording has been made. The resupplying apparatus 10 is composed of resupplying passages A to D as described below, switchback conveying means constituted of a roller pair 13 for switchback conveyance and the like, a position regulator 22 serving as position regulating means, and the like, which are assembled in a frame 30 and integrated as a unit. The resupplying apparatus 10 is used upon inserted in an attaching portion 31 formed in a center of the image forming apparatus body 1. Although the image forming apparatus forms images only on one side of the sheet material where the resupplying apparatus 10 is not yet attached, the image forming apparatus can form images on both sides of the sheet material by attaching the resupplying apparatus 10.

The resupplying apparatus 10 is equipped with an automatic switching device 11 serving as automatic switching means for automatically switching the position of the flapper 9 while the face-up delivery tray 8 is closed to select the conveyance direction of the sheet material S between the face-down passage and the face-up passage. The automatic switching device 11 is constituted of a switching lever 11 a pivotable around a shaft 11*a*1, and a plunger, or solenoid, 11*b* for rendering the switching lever 11*a* pivotably move. A cam follower 11*a*2 to contact the cam member 9*b* fixed to the flapper 9 is formed at one end of the switching lever 11*a*, and the plunger 11*b* is coupled to the other end of the switching lever 11*a*.

A cover member 12 on which a guide surface 12*a* introducing into the resupplying apparatus 10 the sheet material S conveyed out of the image forming apparatus body 1 is formed, is disposed around an inlet for the sheet material of the resupplying apparatus 10. The cover member 12 is pivotable around a shaft 12*b*. The switchback conveyance roller pair 13 rotatable normally and reversely is arranged in a resupplying passage of the resupplying apparatus 10 for switchback conveyance, or namely, for reversing the conveyance direction, of the sheet material S introduced by the inlet for the sheet material S.

The resupplying apparatus 10 is equipped with an openable body 14 releasing part of the resupplying passage and forming a guide. Surface 14*a* constituting part of the resupplying passage. The openable body 14 is pivotably supported around a shaft 14*b* formed at one end of the openable body 14. The cover member 12 is pivotably supported around the other end of the openable body 14; a boss 12*c* of the cover member 12 engages a long hole 14*c* in the openable body 14: a resilient member 15 normally urges the cover member 12 in a counterclockwise direction. Furthermore, as shown in FIG. 1, the numeral 16 is a sensor for detecting as to whether the face-up delivery tray 8 is open or closed by detecting the pivoted position of the cover member 12; the numeral 17 is a sensor for detecting the position of a reversing flapper 18 for guiding a front end of the sheet material S reversely transported and detecting as to whether the openable body 14 is open or closed.

In the resupplying apparatus 10, plural resupplying passages A to E are formed by means of guide members or the like. The resupplying passage A is formed by the cover member 12, the openable body 14, and a curving guide member 19*a*: the resupplying passage B is formed by guide members 20*a*, 20*b* for storing and guiding the sheet material S conveyed in the reverse direction, or under the switchback conveyance: the resupplying passage C is formed by the curving guide member 19*a* and another guide member 19*b* curving similarly to and located inside the guide member 19*a*. The resupplying passage D is formed by a guide member 23 for constituting the position regulator 22 as described below. The resupplying passage E is formed by guide members 21 a, 21*b* connecting the position regulator 22, as described below, with the image forming section 4. The guide members 21*a*, 21*b* are members on a side of the image forming apparatus body 1.

The resupplying apparatus 10 further includes the position regulator 22 for regulating the crosswise position of the sheet material S conveyed by the switchback conveyance roller pair 13. The position regulator 22 includes a guide member 23 having plural contacts regulating the position of the side edge of the respective sheet material by contacting the side edge of the sheet material that may be different in size, and an obliquely conveying roller pair 24 conveying the sheet material S in rendering the side edge of the sheet material in contact with the contacts of the guide member 23. The detailed constitution of the position regulator 22 is described below.

In the drawings, the numeral 25 is a sensor for detecting as to whether the sheet material S exists in the resupplying passage D; the numerals 26, 27 are drive motors as drive sources for driving the switchback conveyance roller pair 13 and the obliquely conveying roller pair 24; the numeral 28 is a board on which a power source, a controller, or the like are mounted.

Now, referring to FIGS. 1 to 6, operation of the resupplying apparatus and the image forming apparatus equipped with the resupplying apparatus is described. With the image forming apparatus, the scanner unit 3 emits information light based on image information onto the electrophotographic photosensitive body 4*a* to form a latent image on the photosensitive body 4*a*, and the latent image is developed to form a toner image. The sheet material S, in synchronous with the formation of the toner image, is conveyed from a cassette 2*a* to the image forming section 4 through a pick-up roller 2*b*, a feeding roller pair 2*c*, and a register roller pair 2*d*, and then, the toner image formed on the electrophotographic photosensitive body 4*a* of the image forming section 4 is transferred onto the sheet material S by the transfer means 5. The sheet material S in the post-transfer stage is conveyed to the fixing means 6, and the transferred toner image is fixed onto the sheet material S.

The sheet material S thus fixed with the image is then conveyed by a conveying roller pair 2*e*. If the face-up delivery tray 8 is closed at that time, since the flapper 9 is located at the solid line position in FIG. 1, the sheet material S is introduced by the flapper 9 (the solid line position) to a reverse passage 2*f*, thereby being delivered on the face-down delivery tray 7 by a delivery roller pair 2*g*. That is, this is the face-down delivery.

If the face-up delivery tray 8 is made open in an arrow direction (the broken line position) in FIG. 1, the flapper 9 is rotated, in association with the opening of the face-up delivery tray 8, in the counterclockwise direction to move to the broken line position shown in FIG. 1, thereby switching the conveyance direction of the sheet material S. Therefore, the sheet material S is introduced by the flapper 9 taking the broken line position and delivered onto the face-up delivery tray 8 through a sheet material outlet 2*h*. That is, this is the face-up delivery.

Figure 2:
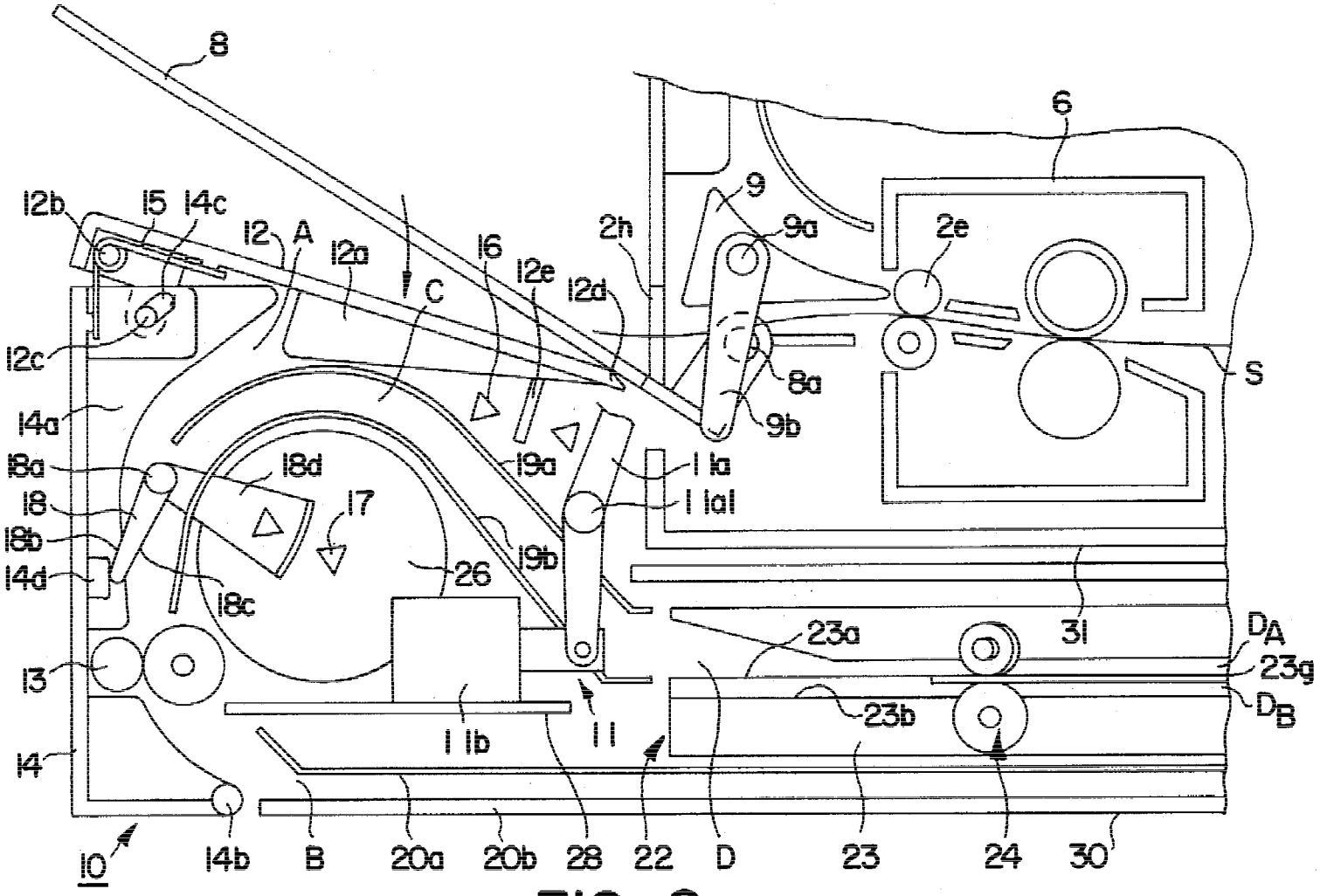
FIGS. 2 to 6 are enlarged side cross sections of essential portions, respectively, showing operation of the apparatus in FIG. 1.

FIG. 2 shows a condition around the sheet material outlet 2*h* at a time of the face-up delivery. The delivery tray 8, upon opening, contacts an end 12*d* formed at a part of the cover member 12 of the resupplying apparatus 10, thereby rotating the cover member 12 around the shaft 12*b* in the clockwise direction as shown by an arrow in FIG. 2 in opposition to resilient force of the resilient member 15. The end 12*d* of the cover member 12 shifts below the sheet material outlet 2*h* of the image forming apparatus body 1 to shut the resupplying passage A, so that the sheet material S delivered in facing up is delivered onto the face-up delivery tray 8 and is accumulated thereon. Since a projection 12*e* formed on the cover member 12 goes to the sensor 16 at that time, the image forming apparatus can detect the face-up delivery state in which the face-up delivery tray 8 is open. In other words, the resupply (both side mode) is possible only where the face-up delivery tray 8 is closed (the face-down delivery state).

Figure 3:
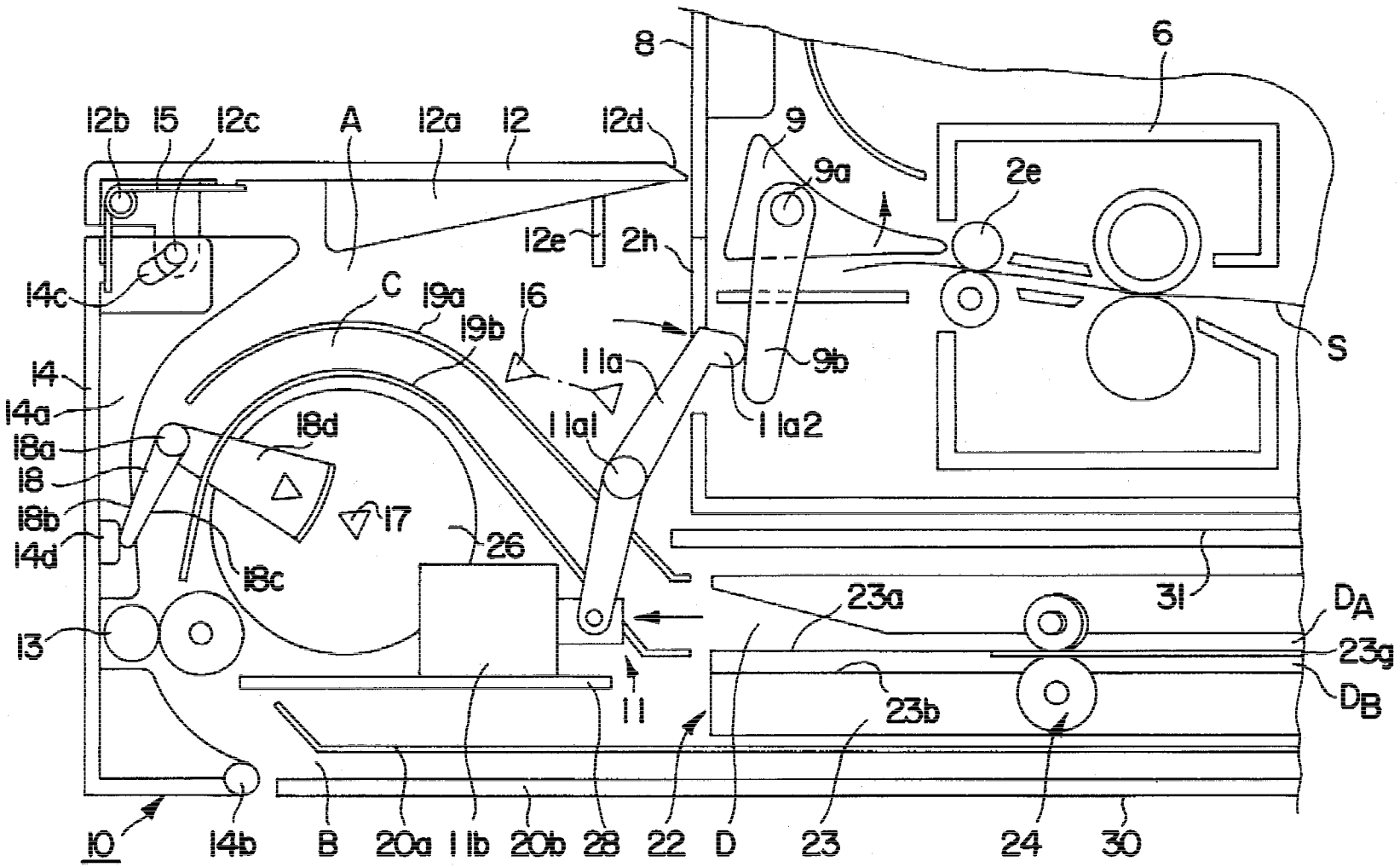

In FIG. 3, when the plunger (solenoid) 11*b* is attracted in an arrow direction while the face-up delivery tray 8 is closed, the switching lever 11*a* rotates around the shaft 11*a*1 in the clockwise direction, or an arrow direction in FIG. 3. Then, the cam follower 11*a*2 formed at one end of the switching lever 11*a* pushes the cam member 9*b* fixed to the flapper 9, thereby rotating the flapper 9 around the shaft 9*a* in the counterclockwise direction, or an arrow direction, and therefore, the image forming apparatus enters the face-up delivery state as described above. That is, the operation of the plunger 11*b* without opening the face-up delivery tray 8 switches the conveyance direction of the sheet material S.

As described above, the conveyance direction of the sheet material S can be switched by co-operation of the flapper 9 and the automatic switching device 11. That is, this conveyance direction is determined by a combination of opening and closing condition of the face-up delivery tray 8 in association with the operation of the flapper 9 and resting and operating condition of the automatic switching device 11 for switching the flapper 9. Specifically, the image forming apparatus can select one of three modes: a first mode to introduce the sheet material S onto the face-up delivery tray 8 by opening the face-up delivery tray 8; a second mode to introduce the sheet material S onto the face-down delivery tray 7 by placing the flapper 9 at a first position shown by the solid line in FIG. 1 while the face-up delivery tray 8 is closed, and a third mode to introduce the sheet material S into the resupplying apparatus 10 by placing the flapper 9 at a second position shown by the broken line in FIG. 1 while the face-up delivery tray 8 is closed.

Figure 4:
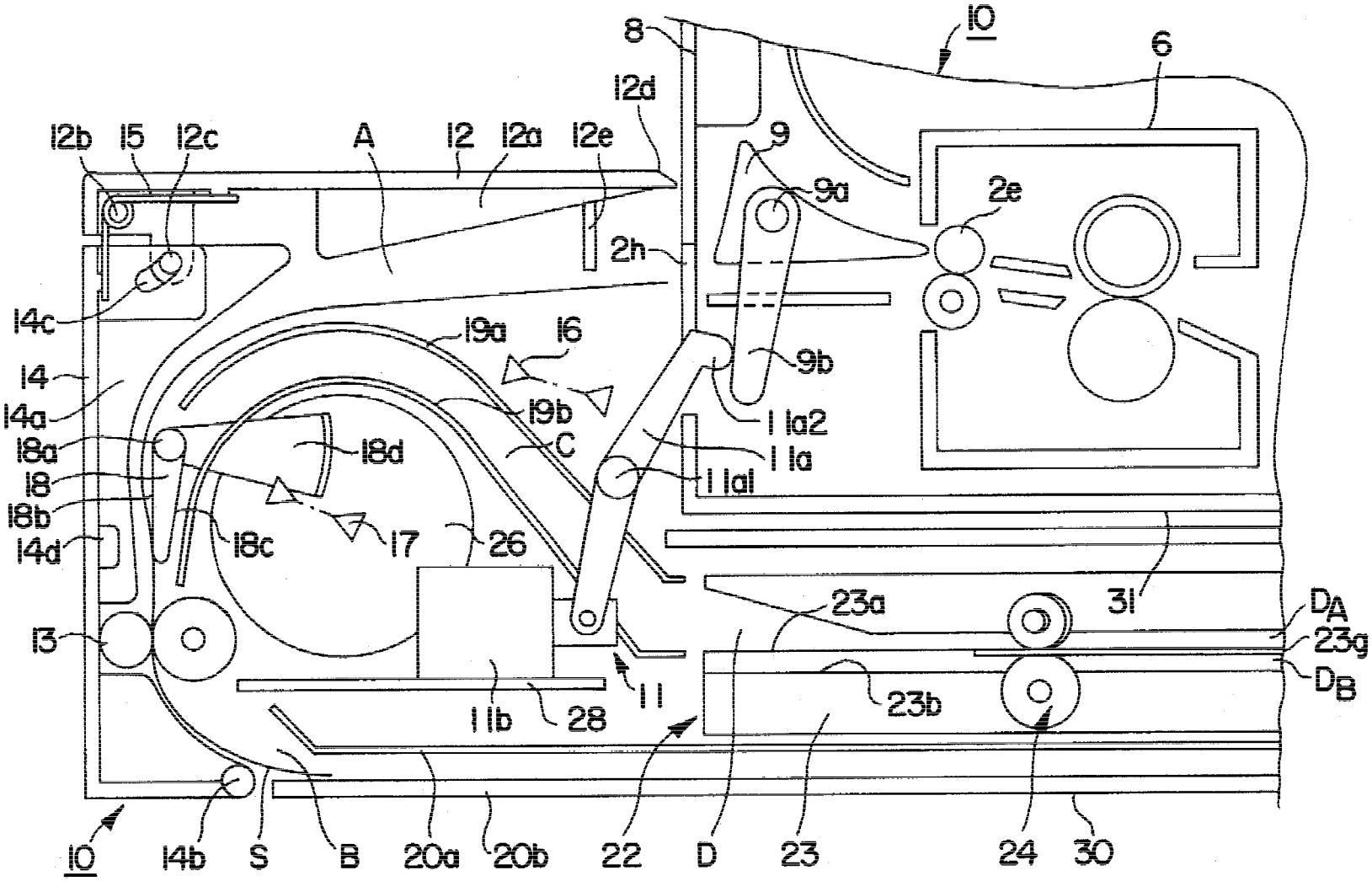

After subject to fixing, the sheet material S conveyed by the conveying roller pair 2*e* changes its conveyance direction by operation of the flapper 9, so that the sheet material S is conveyed in the resupplying passage A in the resupplying apparatus 10 through the sheet material outlet 2*h* of the image forming apparatus body 1. As shown in FIG. 4, then, this sheet material S passes through the reverse flapper 18 in being guided along the guide surface 14*a* of the openable body 14, is clamped and conveyed by the switchback conveyance roller pair 13, and is conveyed in the resupplying passage B.

The reverse flapper 18 is supported pivotably around a shaft 18*a* and includes a contact 18*b* in contact with the sheet material S to be conveyed, a guide portion 18*c* guiding the front end of the sheet material S transported, as the switchback conveyance, or in the reverse direction, a flag portion 18*d* formed at an end of the shaft 18*a*. If no sheet material S exists in the resupplying passage A, the reverse flapper 18 maintains its position as shown in FIG. 3 as the part of the reverse flapper 18 contacts a contact 14*d* formed on the openable body 14. If the sheet material S passes through the reverse flapper 18 as shown in FIG. 4, the reverse flapper 18 rotates in the counterclockwise direction around the shaft 18*a*, and then, existence of the sheet material S in the resupplying passage A is detected upon departure of the flag portion 18*d* of the flapper 18 from the sensor 17.

Figure 5:
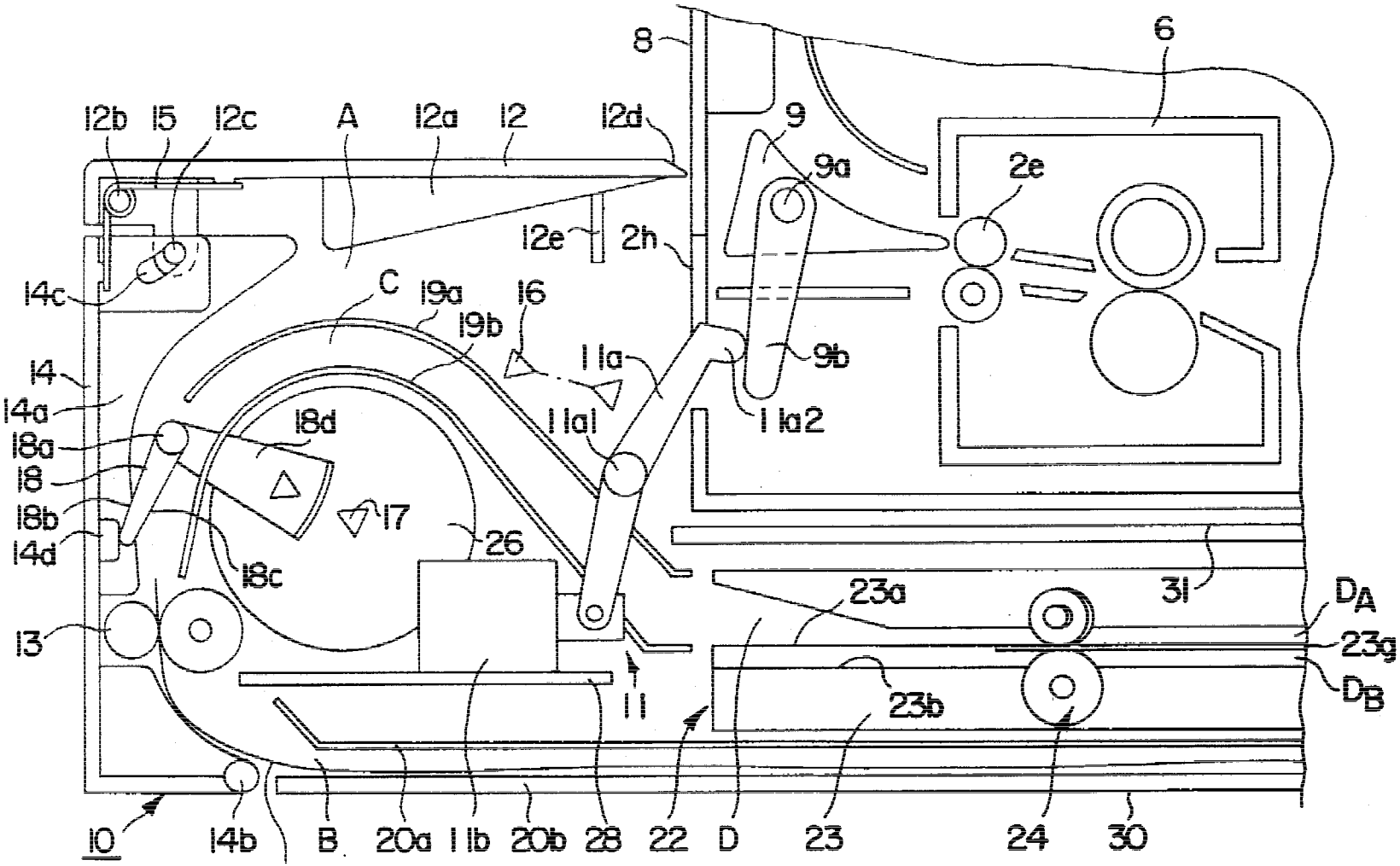
Figure 6:
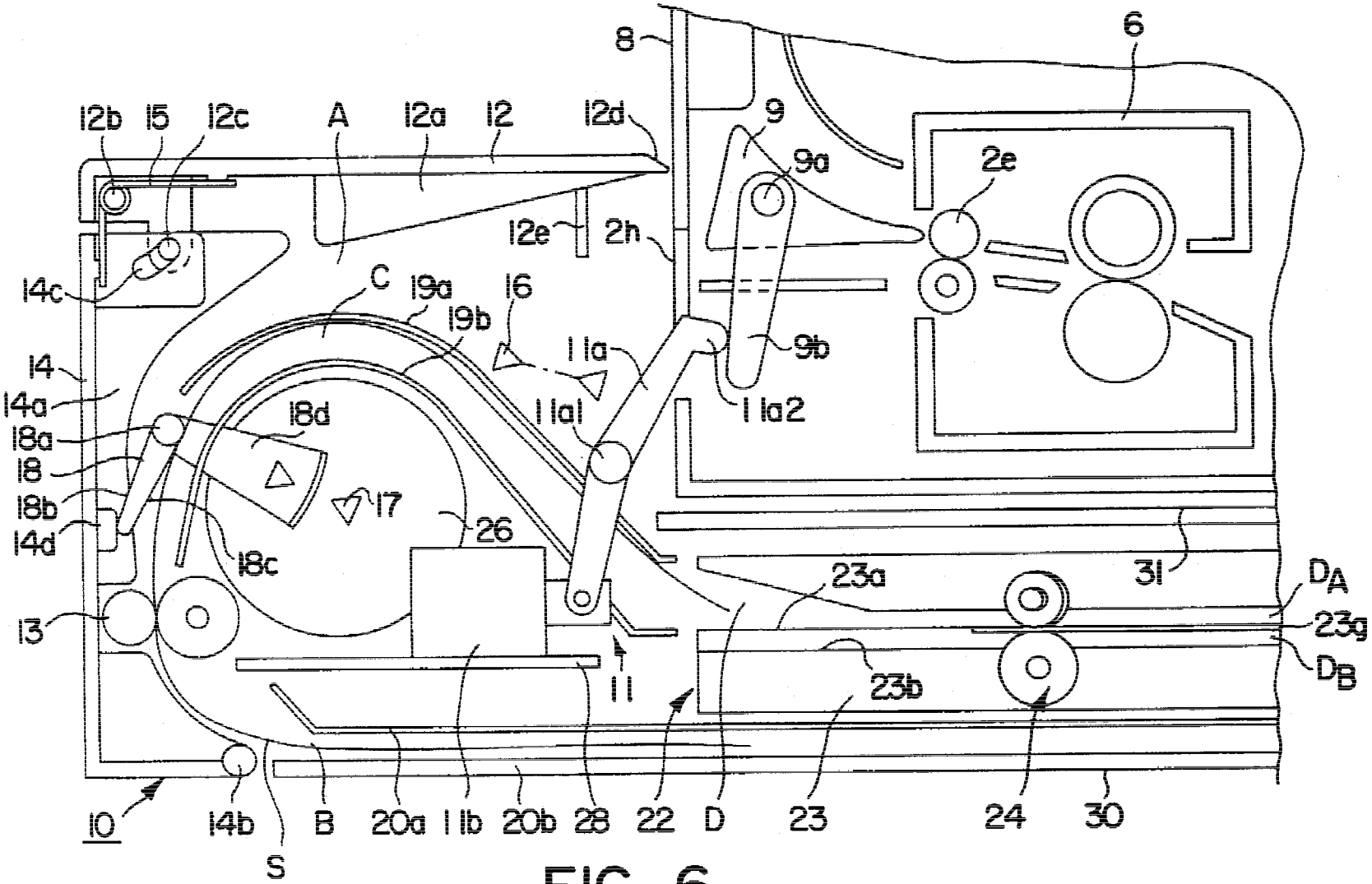

As shown in FIG. 5, when the sheet material S is further conveyed and when the rear end of the sheet material S passes through the reverse flapper 18, the reverse flapper 18 rotates around the shaft 18*a* in the clockwise direction, thereby rendering the flag portion 18*d* thereof enter in the sensor 17 again. That is, the drive motor 26 reversely drives upon detection of the rear end of the sheet material S, and in other words, the switchback operation is performed. According to this switchback operation, the switchback conveyance roller pair 13 is also reversely driven, and as a result, the sheet material S is conveyed into the resupplying passage C in being guided by the guide portion 18*c* of the reverse flapper 18, as shown in FIG. 6.

The resupplying passage C is curved along the conveyance direction of the sheet material S. The sheet material S reversely conveyed by the switchback conveyance roller pair 13 is conveyed along the guide member 19*a*, 19*b*. When the front end of the sheet material S is entered in the resupplying passage D, the sheet material S is introduced into the position regulator 22.

Figure 7:
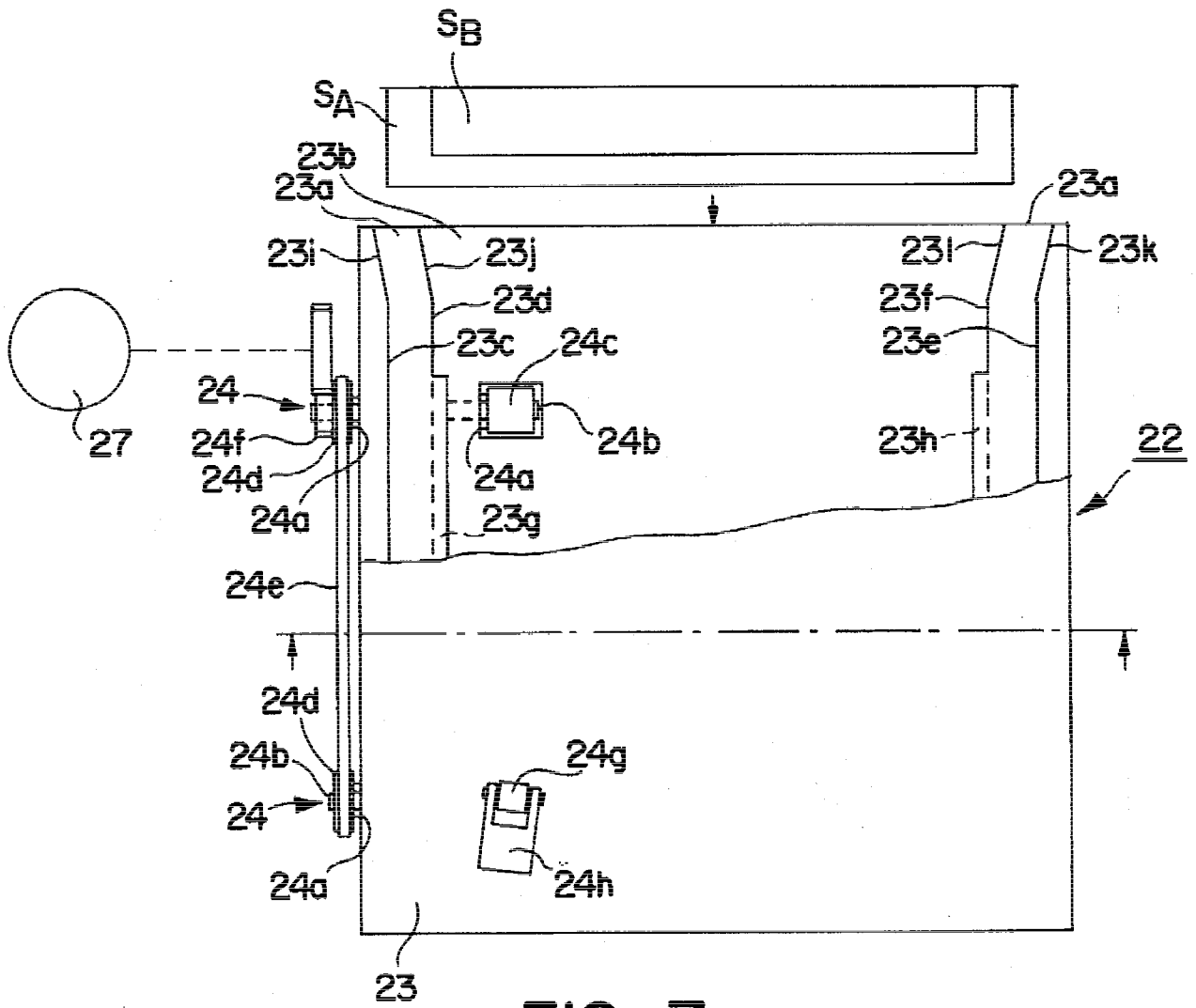
FIG. 7 is a schematic top view showing a position regulator on the apparatus in FIG. 1.
Figure 8:
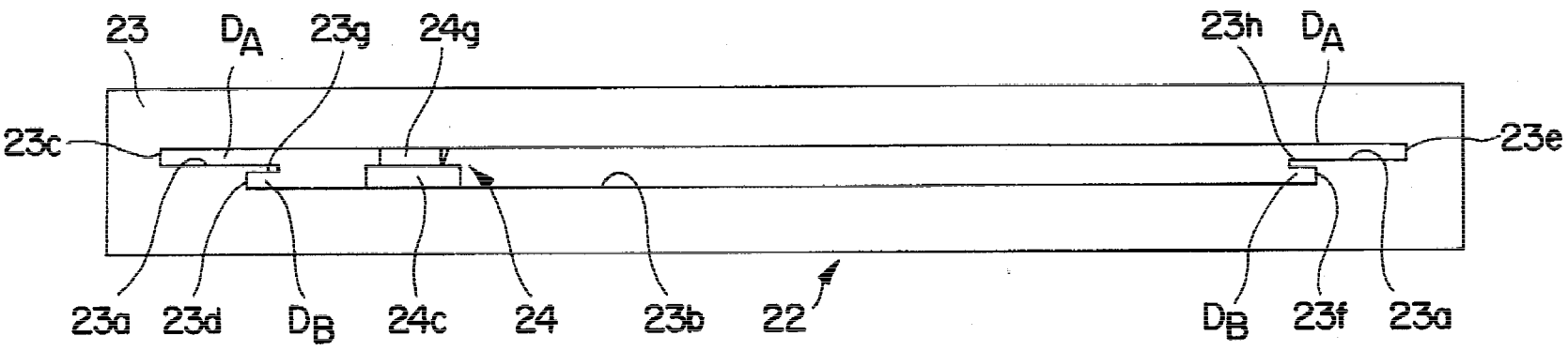
FIG. 8 is a vertical cross section showing the position regulator in FIG. 7.

Referring to FIGS. 7, 8, the position regulator 22 is described. The position regulator 22 includes a guide member 23 having a plurality of contacts for regulating the positions of side edges of the sheet materials different in size, two pairs of obliquely conveying roller pairs 24 sewing as resupplying means. The two pairs of the obliquely conveying roller pairs 24 have substantially the same constitution to each other and include a conveying roller 24*c* for driving, and a roller 24*g* driven in obliquely pushed by the conveying roller 24*c*, respectively. Specifically, the conveying rollers 24*c* made of frictional material is fixed to one end of an drive shaft 24*b* rotatably supported to the guide member 23 by a bearing 24*a*, and a belt pulley 24*d* is fixed to the other end of the drive shaft 24b. Between two pulleys 24d, 24d is a belt 24e tensioned for transmitting drive force. A gear 24f to which the drive force is transmitted from the drive motor 27 is fixed to an end of one drive shaft 24b. Both of the conveying rollers 24d, 24d are driven by this mechanism. Each roller 24g is provided at a position corresponding to the position of the respective conveying rollers 24c so as to be obliquely inclined from the rotary center of the drive shaft 24b, is pushed to the conveying roller 24c by a resilient member 24h, and is supported so as to be driven.

Two guide surface 23a, 23b are formed at the sheet entry area of the guide member 23 so that a sheet material SA with a wide width is conveyed to a passage DA and that a sheet material SB with a narrow width is conveyed to a passage DB. Contact guides 23c to 23f are formed to regulate the crosswise position of the side edges of the respective sheet materials, corresponding to the sheet materials SA, SB having their crosswise sizes (for example, A4 and B5 sizes) different from each other, and are formed in a stepwise shape to extend in a direction perpendicular to the conveyance direction of the sheet materials S. On a side at which the side edge of the sheet material S contacts the guides by operation of the obliquely conveying rollers 24, particularly, the contact guides 23c, 23d are disposed to serve as a positional reference in the crosswise direction of the sheet materials S. In this embodiment, the contact guide 23c arranged on an upper side provides a reference for sheet materials SA having a larger A4 size in the crosswise direction; the contact guide 23d arranged on a lower side provides a reference for sheet materials SB having a smaller B5 size in the crosswise direction. A guide 23g is formed between the resupplying passages DA, DB on the reference side to keep the sheet material SB having the smaller crosswise size located in the resupplying passage DB away from the resupplying passage DA. Similarly, a guide 23h is also formed between the resupplying passages DA, DB on the non-reference side. Inclined surfaces 23i to 23l are formed at an entry area for the sheet materials of the guide member 23 to broaden the entry opening so that the sheet materials conveyed by the switchback conveyance roller pair 13 are easily entered into the position regulator 22.

The respective sheet materials SA, SB introduced by the position regulator 22 thus constituted, are conveyed as shown in FIG. 9, notwithstanding their crosswise sizes, while one side edge of the sheet materials SA, SB is in contact with the respective guide portions 23c, 23d according to the operation of the two sets of the obliquely conveying rollers 24, and therefore, the crosswise position of each sheet material is regulated adequately. After regulated, the sheet material S conveyed by the obliquely conveying roller pairs 24 is resupplied to the image forming section 4 through a passage E from the rear end of the sheet material S with an up-side-down state from the original face state. Then, the sheet material S is subject to image forming operation as described above, and with images on both sides, is delivered onto the face-down delivery tray 7 by the delivery roller pair 2g and held thereon.

Figure 10:
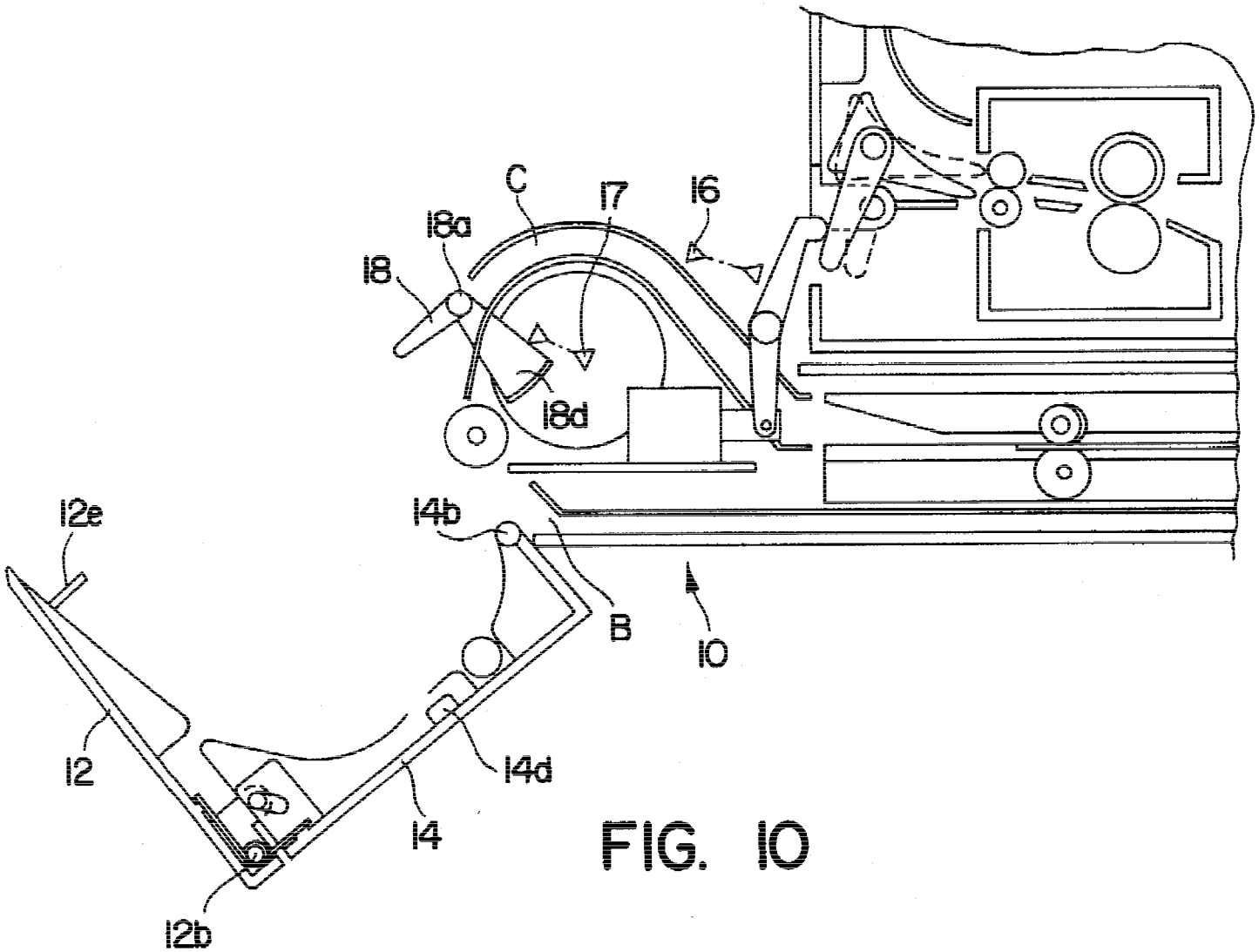
FIG. 10 is a side cross section of an essential portion of the resupplying apparatus, showing an open state of an opening and closing mechanism in the resupplying apparatus.

If paper jamming occurs in the resupplying apparatus 10, the resupplying passages A to C can be broken up by opening the openable body 14 as shown in FIG. 10, so that the jammed sheet material can be removed easily. Since the openable body 14 is coupled pivotably to the cover member 12, if the openable body 14 is made open as shown in FIG. 10, the cover member 12 is also made open together. The projection 12e of the cover member 12 is escaped from the sensor 16 at that time, and the flag portion 18d is also escaped from the sensor 17 in conjunction with a clockwise rotation of the reverse flapper 18 around the shaft 18a caused by outgoing movement of the contact 14d of the openable body 14. That is, the combination of the two sensors 16, 17 gives information as to whether the openable body 14 is open or not, and if the openable body 14 is open, neither of the image forming apparatus 1 and the resupplying apparatus 10 operate.

When the image information light (laser light) is scanned onto the image forming section 4 from the scanner unit 3, the image forming section 4 can operate corresponding to various sizes of the sheet materials by changing the home position of the laser beam in accordance with kinds of the resupplied sheet materials. For example, even if an LTR paper is conveyed, instead of the sheet material in the A4 size, into the resupplying passage DA, or even if an EXEC paper is conveyed, instead of the sheet material in the B5 size, into the resupplying passage DB, the image forming section 4 can always produce images in maintaining a constant margin on the reference side notwithstanding the kinds of sheet materials by shifting more or less the home position of the laser beam.

Other Embodiments

Figure 11:
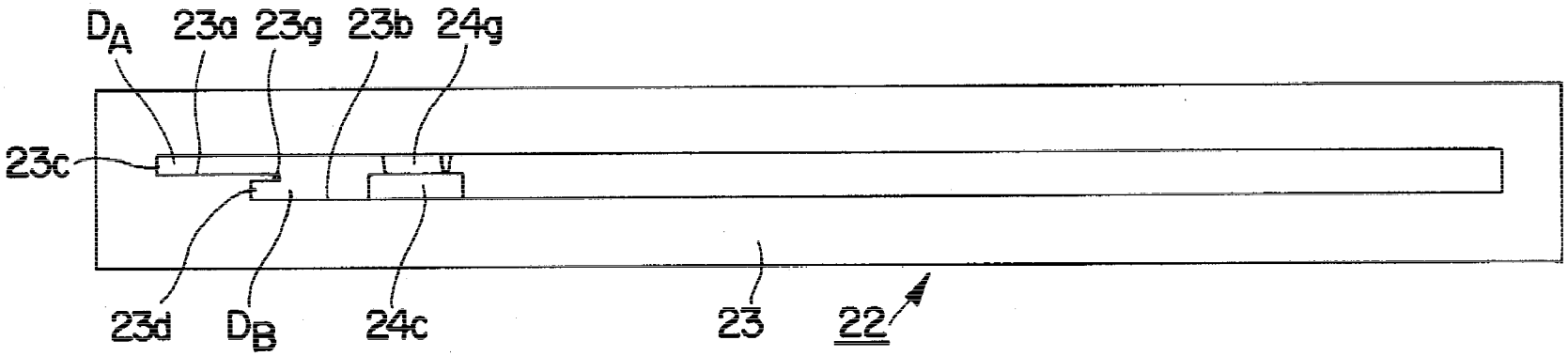
FIGS. 11, 12 are schematic vertical cross sections showing other position regulators, respectively.

Although in the embodiment above the two resupplying passages are formed on both sides of the guide member 23 of the position regulator 22, this invention is not limited to this feature and can be formed with the guide member 23 in a shape, for example, shown in FIG. 11. The guide member 23 is formed with, on the reference side, the resupplying passages DA, DB made of guide surfaces 23a, 23b, contact guides 23c, 23d, and a guide 23g and with, on the non-reference side, no resupplying passage. The guide member 23 can obtain the same effects as the above guide member 23.

Figure 12:
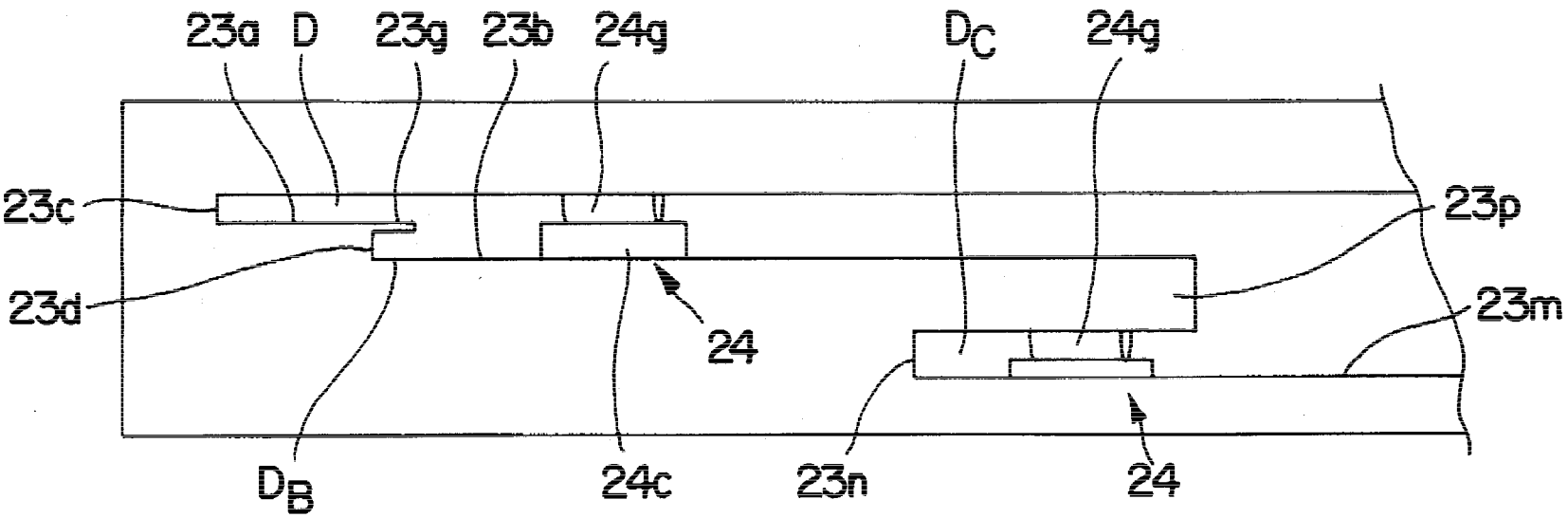

As shown in FIG. 12, the image forming apparatus can correspond a special sheet material having an extremely narrow width such as of post cards, business cards, and envelopes, by providing, to the position regulator 22, a resupplying passage DC made of an additional guide surface 23m, a contact guide 23n, and a guide 23p, and obliquely conveying roller pairs 24. By providing plural resupplying passages can the image forming apparatus correspond to sheet materials of various sizes.

Figure 13:
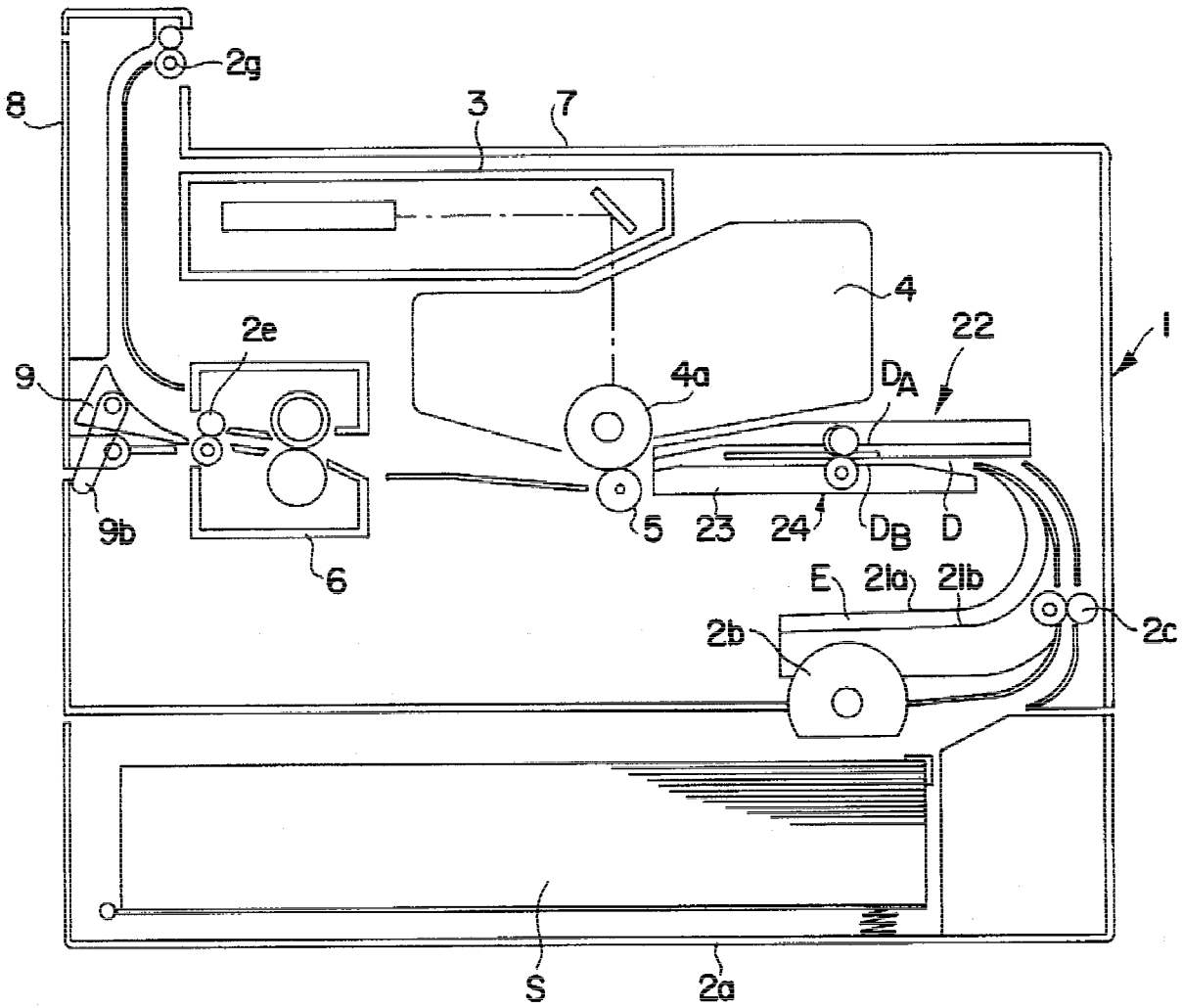
FIGS. 13 to 15 are schematic side cross sections showing image forming apparatus with the position regulator, respectively.

The image forming apparatus can as shown in FIG. 13 regulate the crosswise position of the sheet material S supplied from the cassette 2a by disposing the position regulator 22 thus constituted on the upstream side of the image forming section 4. At that time, a wide sheet material SA is conveyed to a lower resupplying passage DA whereas a narrow sheet material SB is conveyed to an upper resupplying passage DB, and both sheet materials are then conveyed to the image forming section 4 with the regulated position. According to the position regulator 22 thus constructed, the image can be precisely placed on the respective sheet materials S because the crosswise position of the sheet material S is regulated immediately before the sheet material S is conveyed into the image forming section 4.

Figure 14:
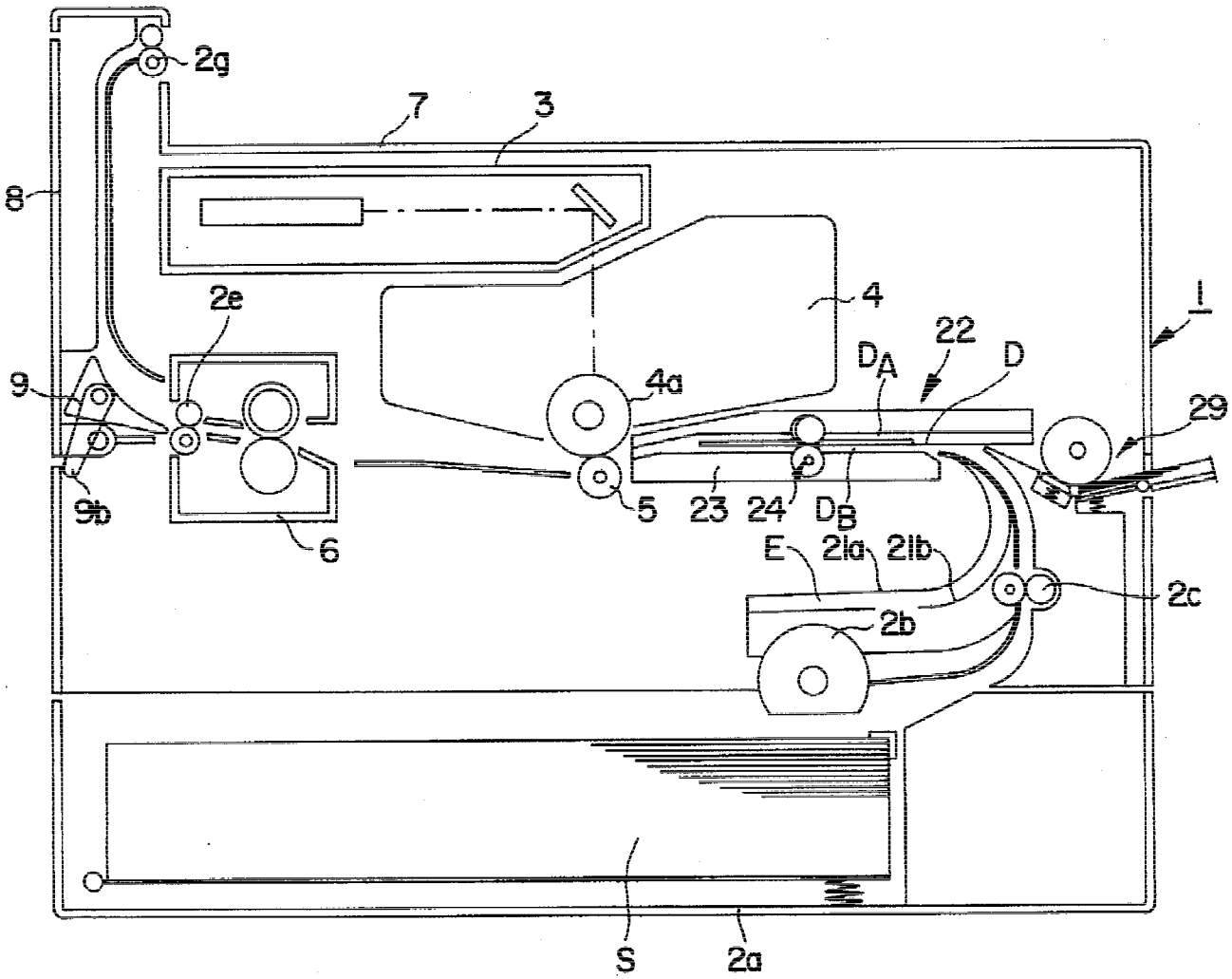

As shown in FIG. 14, a supplying apparatus 29 such as a multiple feeder or a manual feeder may be arranged, in addition to the structure above, immediately on an upstream side of the position regulator 22, thereby enabling the image forming apparatus to regulate the crosswise position of the sheet material S easily and precisely only by providing an additional coarse guide on the side of the supplying apparatus 29.

Figure 15:
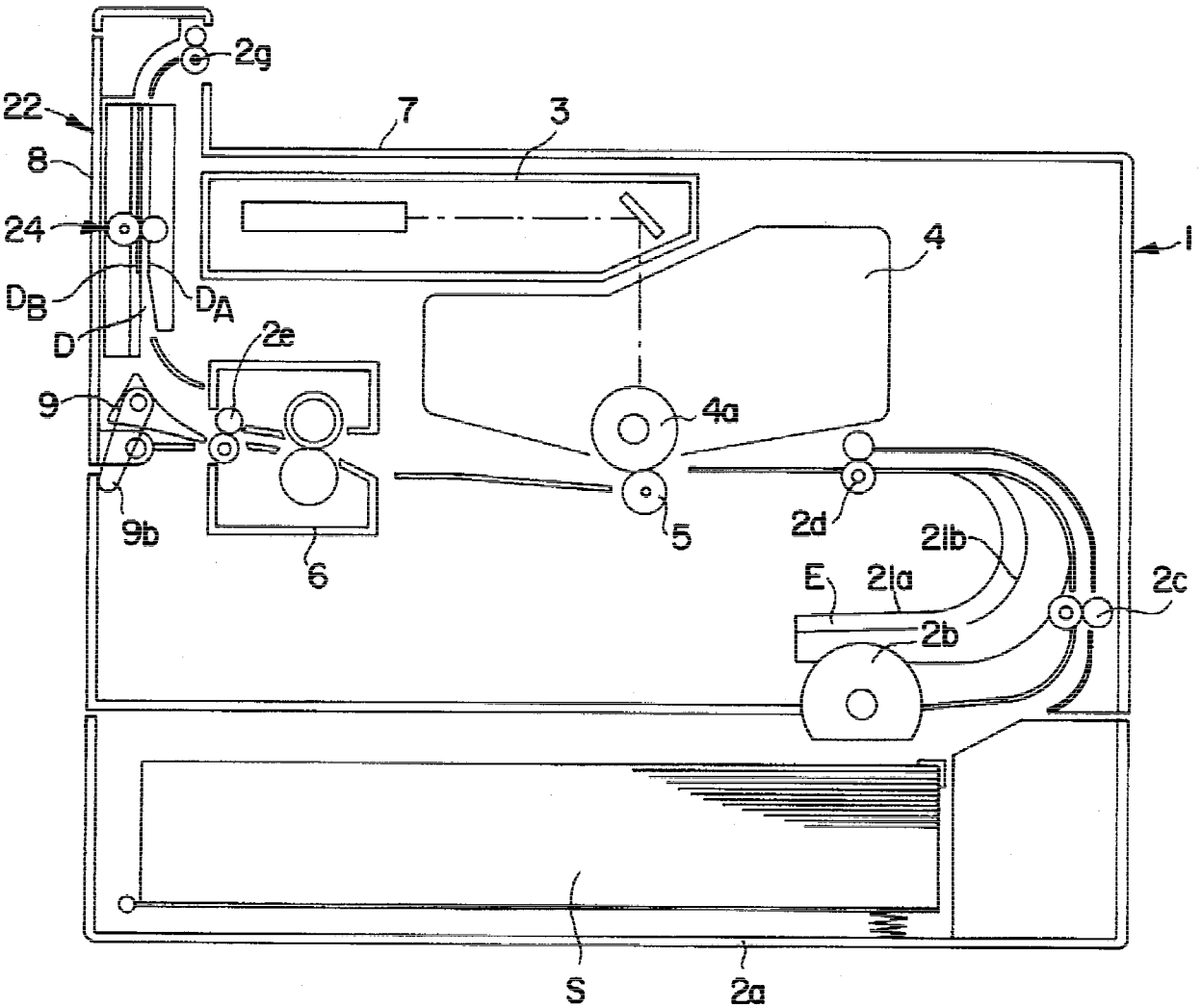

As shown in FIG. 15, the position regulator 22 thus constituted can be arranged immediately on an upstream side of the delivery roller pair 2g disposed near the outlet for the sheet materials S. In such a situation, similarly, a wide sheet material SA is conveyed to a resupplying passage DA whereas a narrow sheet material SB is conveyed to a resupplying passage DB, and both sheet materials are then conveyed while their positions are regulated and delivered on the face-down delivery tray 7 by means of the delivery roller pair 2g. Accordingly, sheet materials S (bundle of sheet materials) can be held on the face-down delivery tray 7 with the precise positions of the sheet materials S.

It is to be noted that in the embodiments shown in FIGS. 13 to 15, the position regulator 22 in the resupplying apparatus can be omitted. Although in the embodiments above the laser printer is exemplified as the image forming apparatus, this invention is not limited to this feature, and other image forming apparatus such as a photocopier, a facsimile machine, and a word processor, can obtain substantially the same effects.

Although in the embodiments above, the face-down delivery tray 7 and the face-up delivery tray 8 serve as the first tray member and the second tray member, respectively, the delivery feature as to which face of the sheet material S is up is not limited to this. For example, when the image forming section 4, which is formed on the upper side of the passage in the embodiments, is formed on the lower side of the passage, the delivery feature is not limited to one of the above embodiments, and the face-down delivery tray and the face-up delivery tray may serve as the second tray member and the first tray member, respectively.

As described above, according to the embodiments of this invention, the sheet materials one side of which recording is made are resupplied by transportation of the sheet materials from the sheet outlet of the image forming apparatus body to the sheet inlet of the resupplying apparatus by means of the passage switching member that switched by the automatic switching means so that the resupplying passage serves as the sheet material conveyance direction while the tray member is closed and of the guide member of the cover member arranged around the sheet inlet of the resupplying apparatus, so that the image forming apparatus does not lose its fine appearance because the entire sheet material is contained within the image forming apparatus and the resupplying apparatus while the sheet material is subject to resupplying operation, in particular, during a waiting period for switchback conveyance, and so that since no opening is made, general and reflected noises are reduced.

Since the image forming apparatus is formed with the openable body having the guide portion for releasing part of the resupplying passage and forming part of the resupplying passage, paper jamming is easily treated only by opening the openable body, thereby improving user's controllability. Furthermore, since the image forming apparatus is formed with the sheet material sensors for detecting as to whether the openable body is open or closed and as to whether the sheet material exists in the resupplying apparatus to be broken up, the apparatus does not start operating while the openable body remains open. The switchback conveyance is conducted smoothly because the sheet material sensors are arranged in proximity of the upstream side of the switchback conveying means formed in the resupplying passages and have the guide portions to guide the front end of the sheet material conveyed in the reverse direction, and the image forming apparatus can be formed with less costs because of the reduced number of parts.

Since the position regulating means for regulating the position in the crosswise direction of the sheet material conveyed by the switchback conveying means includes the guide member having a plurality of contacts for regulating positions of the respective sheet materials of different sizes thereof by contacting the side edges of the sheet materials, and obliquely conveying means for conveying the sheet materials while rendering the side edges of the sheet materials in contact with the contacts of the guide member, and since the contacts of the guide member are formed at positions corresponding to the respective sizes of the sheet materials so as to extend in a stepwise shape from the outer side toward the center of the sheet material in a perpendicular direction to the conveyance direction of the sheet material, the constitution of the position regulating means is simplified, thereby enabling the apparatus to reduce costs, energy consumption, size, weight, and noise.

The resupplying apparatus can make the size thereof compact, because the resupplying apparatus has the curving guide member located between the switchback conveying means and the position regulating means and curved along the conveyance direction of the sheet material for guiding the sheet material conveyed in the switchback conveyance, and because the resupplying apparatus has a driver source located inside of the curved guide member for driving the resupplying apparatus.

The image forming apparatus can precisely position the images on the sheet materials S by disposing the position regulating means thus constituted on a side of the image forming apparatus, or more specifically, by disposing it on the upstream side of the image forming section in the sheet material conveyance direction, because the crosswise position of the sheet material is regulated immediately before the sheet material S is conveyed into the image forming section. Furthermore, by providing the position regulating means immediately on the upstream side of the sheet outlet in the sheet material conveyance direction, the position of the sheet materials (bundle of sheet materials) held on the delivery tray can be regulated.

This invention, since thus constituted, can be suitable regarding its appearance and can reduce noise. As described above, though the preferred embodiments of the invention is described, a person skilled in the art can easily conceive other variations. Accordingly, this invention is not limited to the embodiments above, and variations of the invention are to be covered by claims as set forth below.

What is claimed is:

1. A sheet material resupplying apparatus attached to an image forming apparatus body having image forming means for forming an image on a sheet material, a first tray member for holding thereon the sheet material conveyed out of the image forming means so that one side of the sheet material is up, and a second tray member capable of being open or closed for holding thereon the sheet material conveyed out of the image forming means when the second tray member is opened so that the other side of the sheet material is up, said resupplying apparatus sending back said sheet material on which an image has been formed by image forming means to said image forming means, and said sheet material resupplying apparatus comprising:

a resupplying passage connecting a sheet material passage on a downstream side of the image forming means with another sheet material passage on an upstream side of the image forming means;

switchback conveying means placed in the resupplying passage for reversing the conveyance direction of the sheet material;

resupplying means for returning the sheet material to the upstream side of the image forming means through the resupplying passage; and selecting means for selecting, while the second tray member is closed, the conveyance direction of the sheet material between a conveyance direction to the first tray member and a conveyance direction to the resupplying passage.

2. The sheet material resupplying apparatus according to claim 1, wherein said resupplying passage, said switchback means, said resupplying means, and said selecting means are assembled in a frame and integrated into a unit.

3. The sheet material resupplying apparatus according to claim 1 or 2, further comprising an openable body disposed on an upstream side of the switchback conveying means, said openable body allowing the sheet material to pass to the switchback conveying means and guiding to the upstream side of the image forming means the sheet material conveyed in a direction reversed by the switchback conveying means.

4. The sheet material supplying apparatus according to claim 3, further comprising sheet detecting means for detecting existence of the sheet material in the resupplying passage in association with open or closed state of the openable body, whereby the conveyance direction of the sheet material is reversed when the sheet detecting means detects a pass of the sheet material being conveyed to the switchback conveying means.

5. The sheet material resupplying apparatus according to claim 4, wherein said sheet detecting means detects an open or closed state of said operable body.

6. An image forming apparatus comprising:

a resupplying passage connecting a sheet material passage on a downstream side of an image forming means with another sheet material passage on an upstream side of the image forming means;

switchback conveying means placed in the resupplying passage for reversing the conveyance direction of the sheet material;

resupplying means for returning the sheet material to the upstream side of the image forming means through the resupplying passage;

a first tray member for holding thereon the sheet material conveyed out of the image forming means so that one side of the sheet material is up;

a second tray member capable of being open or closed for holding thereon the sheet material conveyed out of the image forming means when said second tray member is opened so that the other side of the sheet material is up;

a passage switching member for switching, in associated with an opening or a closing operation of the second tray member, the passage of the sheet material among the conveyance directions to the first tray member, the second tray member, and the resupplying passage; and selecting means for selecting, while the second tray member is closed, the conveyance direction of the sheet material between a conveyance direction to the first tray member and a conveyance direction to the resupplying passage by switching operation of the passage switching member.

7. The image forming apparatus according to claim 6, wherein said resupplying passage, said switchback conveying means, said resupplying means, and said selecting means are assembled in a frame and integrated into a unit, which is detachably attached to an image forming apparatus body.

8. The image forming apparatus according to claim 6 or 7, further comprising an openable body disposed on an upstream side of the switchback conveying means, said openable body allowing the sheet material to pass to the switchback conveying means and guiding to the upstream side of the image forming means the sheet material conveyed in a direction reversed by the switchback conveying means.

9. The image forming apparatus according to claim 8, further comprising sheet detecting means for detecting existence of the sheet material in the resupplying passage, whereby the conveyance direction of the sheet material is reversed when the sheet detecting means detects a pass of the sheet material.

10. The image forming apparatus according to claim 6, wherein said sheet materials are held, on the first tray member so as to face down, or so that the recorded side of each sheet material is down, and on the second tray member so as to face up, or so that the recorded side of each sheet material is up.

11. The image forming apparatus according to claim 6, wherein said sheet materials are held, on the first tray member so as to face up, or so that the recorded side of each sheet material is up, and on the second tray member: so as to face down, or so that the recorded side of each sheet material is down.

12. The sheet material resupplying apparatus according to claim 9, wherein said sheet detecting means detects open or closed state of said operable body.

13. An image forming apparatus comprising:

an image forming means for forming an image on a sheet material;

a first tray member for holding thereon the sheet material conveyed out of the image forming means os that one side of the sheet material is up;

a second tray member capable of being open or closed for holding thereon the sheet material conveyed out of the image forming means when said second tray member is opened so that the other side of the sheet material is up;

a resupplying apparatus located on a downstream side of the image forming means for returning to an upstream side of the image forming means the sheet material conveyed from the image forming means in a state that the conveyance direction of the sheet material is reversed; and switching means located on the downstream side of the image forming means moving to a first position for introducing the sheet material to the first tray member and a second position for introducing the sheet material to either the second tray member or the resupplying apparatus, whereby the image forming apparatus is controlled under one of a first mode in which while the second tray is open the switching means is moved to the second position for introducing the sheet material to the second tray member, a second mode in which while the second tray is closed the switching means is moved to the first position for introducing the sheet material to the first tray member, and a third mode in which while the second tray is closed the switching means is moved to the second position for introducing the sheet material to the resupplying apparatus.

14. A sheet material resupplying apparatus comprising:

a resupplying passage connecting a sheet material passage on a downstream side of an image forming means in an image forming apparatus body with another sheet material passage on an upstream side of the image forming means;

switchback conveying means placed in the resupplying passage for reversing the conveyance direction of the sheet material from a conveyer in the image forming apparatus body;

resupplying means for returning the sheet material to the upstream side of the image forming means through the resupplying passage; and position regulating means for regulating the position in a crosswise direction of the sheet material conveyed by the switchback conveying means, said position regulating means including a guide member having a plurality of contacts for regulating positions of respective sheet materials of different sizes thereof by contacting the edges of the sheet materials and including obliquely conveying means for conveying the sheet materials while the edges of the sheet materials are contacted with the contacts of the guide member.

15. The sheet material resupplying apparatus according to claim 14, wherein said contacts of the guide member are formed corresponding to the respective sizes of the sheet materials so as to extend in a stepwise shape from the edge toward the center of the sheet material in a perpendicular direction to the conveyance direction of the sheet material.

16. The sheet material resupplying apparatus according to claim 14, further comprising a curving guide member located between the switchback conveying means and the position regulating means and curved along the conveyance direction of the sheet material for guiding the sheet material conveyed in the reversed conveyance direction.

17. The sheet material resupplying apparatus according to claim 16, further comprising a driver located inside of the curved guide member for driving the resupplying apparatus.

18. An image forming apparatus comprising:

conveying means for conveying a sheet material;

image forming means formed in an image forming apparatus body for recording an image on the sheet material;

a resupplying apparatus returning the sheet material that have passed through the image forming means, said resupplying apparatus comprising: a resupplying passage connecting a sheet material passage on a downstream side of the image forming means with another sheet material passage on an upstream side of the image forming means;

switchback conveying means placed in the resupplying passage for reversing the conveyance direction of the sheet material from a conveyer in the image forming apparatus body; and resupplying means for returning the sheet material to the upstream side of the image forming means through the resupplying passage; and position regulating means for regulating the position in a crosswise direction of the sheet material, said position regulating means comprising: a guide member having a plurality of contacts for regulating positions of respective sheet materials of different sizes thereof by contacting the edges of the sheet materials; and obliquely conveying means for conveying the sheet materials while the edges of the sheet materials are contacted with the contacts of the guide member.

19. The image forming apparatus according to claim 18, wherein said contacts of the guide member are formed corresponding to the respective sizes of the sheet materials so as to extend in a stepwise shape from the edge toward the center of the sheet material in a perpendicular direction to the conveyance direction of the sheet material.

20. The image forming apparatus according to claim 19, wherein said resupplying apparatus includes a curving guide member located between the switchback conveying means and the position regulating means and curved along the conveyance direction of the sheet material for guiding the sheet material conveyed in the reversed conveyance direction.

21. The image forming apparatus according to claim 20, further comprising a driver located inside of the curved guide member for driving the resupplying apparatus.

22. The image forming apparatus according to claim 18 or 19, wherein said position regulating means is disposed on an upstream side of the image forming apparatus in the conveyance direction of the sheet material.

23. The image forming apparatus according to claim 18 or 19, wherein said position regulating means is disposed on a downstream side of a source for the sheet materials in the conveyance direction of the sheet material.

24. A sheet material resupplying apparatus detachably attached to an image forming apparatus body, comprising:

resupplying means connecting a sheet material passage on a downstream side of an image forming means in the image forming apparatus body with another sheet material passage on an upstream side of the image forming means;

switchback conveying means placed in the resupplying means for reversing the conveyance direction of the sheet material resupplied, wherein said switchback conveying means has a curved guide member and switchback resupplying passage in which the sheet conveyed by said curved guide member is stored; and a downstream resupplying passage placed in a downstream side of said switchback conveying means for conveying the sheet reversed by said switchback conveying means, wherein said switchback resupplying passage of said switchback conveying means and said downstream resupplying passage are partially positioned in said image forming apparatus body.

25. The sheet material resupplying apparatus according to claim 24, wherein said curved guide member is positioned out of said image forming apparatus body, and said downstream resupplying passage is located above said resupplying passage of said switchback conveying means.

26. The sheet material resupplying apparatus according to claim 25, wherein said resupplying passage of said switchback conveying means and said downstream resupplying passage are inserted in an attaching portion of said image forming apparatus body.

27. An image forming apparatus comprising:

a resupplying passage connecting a sheet material passage on a downstream side of an image forming means with another sheet material passage on an upstream side of the image forming means;

switchback conveying means placed in the resupplying passage for levelling the conveyance direction of the sheet material; and tray means capable of being open or closed for holding thereon the sheet material conveyed out of the image forming means, wherein the sheet material on a first side thereof is held on said tray means when said tray means is opened, and the sheet material formed an image on a first side thereon is conveyed to said switchback conveying means when said tray means is closed.

28. An image forming apparatus according to claim 27, further comprising a second tray means for holding the sheet material resupplied by said resupplying passage for forming an image on a second side thereof by said image forming means, and switching means for conveying the sheet material with the image formed on the second side to said second tray.

29. The image forming apparatus according to claim 27, wherein said switchback conveying means has a curved guide member and switchback resupplying passage in which the sheet conveyed by said curved guide member is stored and said resupplying passage has a downstream resupplying passage placed in a downstream side of said switchback conveying means for conveying the sheet reversed by said switchback conveying means, wherein said switchback resupplying passage of said switchback conveying means and said downstream resupplying passage are partially positioned in said image forming apparatus body.

30. The image forming apparatus according to claim 29, wherein said resupplying passage is detachably attached to the image forming apparatus body.

* * * * *

UNITED STATES PATENT AND TRADEMARK OFFICE

CERTIFICATE OF CORRECTION

PATENT NO. : 5,708,954

DATED : January 13, 1998

INVENTOR(S) : Masao Ando, et al.

It is certified that error appears in the above-identified patent and that said Letters Patent is hereby corrected as shown below:

COLUMN 2

Figure 9A:
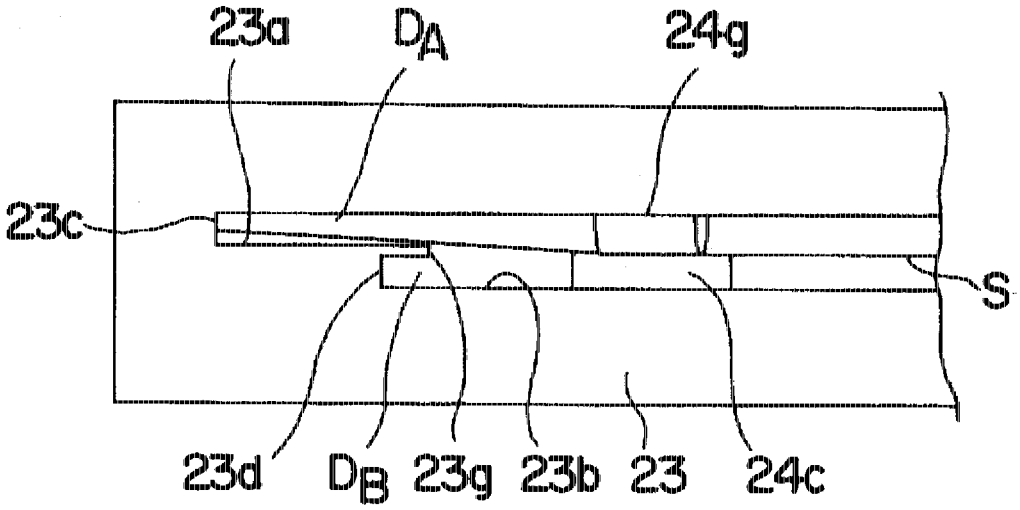
FIGS. 9(*a*) and 9(*b*) are enlarged vertical cross sections of an essential portion, showing operation of the position regulator in FIG. 1.
Figure 9B:
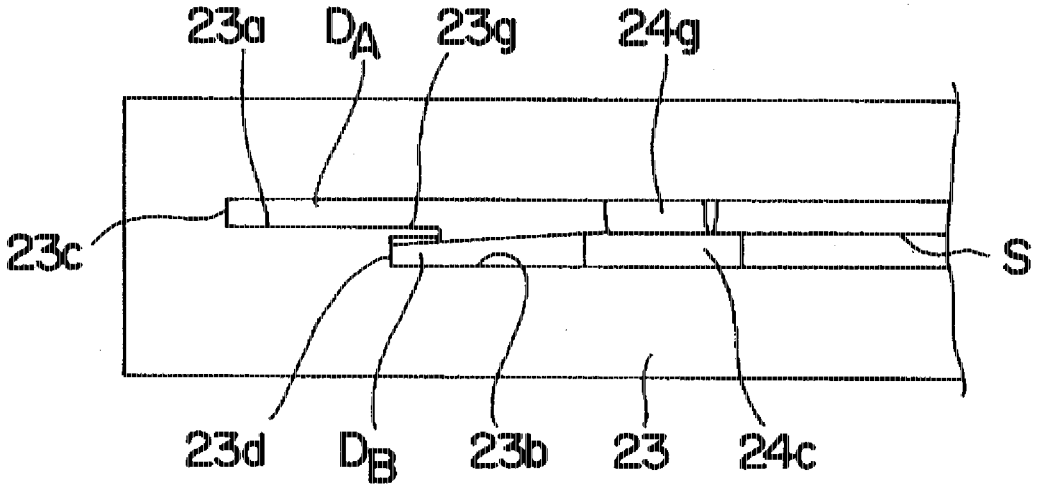

Line 32, "FIGS. 9(a) and 9(b)" should read --FIGS. 9A and 9B--.

COLUMN 4

Line 7, "guide. Surface 14a" should read --guide surface 14a--; and

Line 66, "synchronous" should read --synchronism--.

COLUMN 6

Line 59, "sewing" should read --serving--.

COLUMN 11

Line 28, "operable" should read --openable--; and
Line 48, "associated" should read --association--.

UNITED STATES PATENT AND TRADEMARK OFFICE

CERTIFICATE OF CORRECTION

PATENT NO. : 5,708,954

DATED : January 13, 1998

INVENTOR(S) : Masao Ando, et al.

It is certified that error appears in the above-identified patent and that said Letters Patent is hereby corrected as shown below:

COLUMN 12

Line 24, "open" should read --an open--;
Line 25, "operable" should read --openable--; and
Line 30, "os" should read --so--.

Signed and Sealed this

Second Day of February, 1999

*Attest:*

*Attesting Officer*

*Acting Commissioner of Patents and Trademarks*